United States Patent [19]

Winkler et al.

[11] Patent Number: 4,728,096

[45] Date of Patent: Mar. 1, 1988

[54] COMPACT APPARATUS FOR DISPENSING A PRESELECTED MIX OF PAPER CURRENCY OR THE LIKE

[75] Inventors: Theodore Winkler, Levittown, Pa.; Fredric W. Burger, Cherry Hill, N.J.

[73] Assignee: Brandt, Inc., Bensalem, Pa.

[21] Appl. No.: 941,228

[22] Filed: Dec. 12, 1986

Related U.S. Application Data

[62] Division of Ser. No. 699,044, Feb. 7, 1985, Pat. No. 4,660,822.

[51] Int. Cl.[4] ..... B65H 1/24

[52] U.S. Cl. ..... 271/166; 271/9; 271/134; 271/137; 221/197

[58] Field of Search ..... 271/131-144, 271/166, 9, 10; 221/133, 198, 197, 43, 46, 36, 42

[56] References Cited

U.S. PATENT DOCUMENTS

| | | | |
|---|---|---|---|
| 3,151,771 | 10/1964 | Greene | 221/198 |
| 3,887,106 | 6/1975 | Charlson et al. | 221/197 |
| 3,977,666 | 8/1976 | Suzuki et al. | 271/9 |
| 4,021,032 | 5/1977 | Gross et al. | 271/166 |
| 4,231,556 | 11/1978 | Suzuki | 271/117 |

FOREIGN PATENT DOCUMENTS

| | | | |
|---|---|---|---|
| 0190129 | 10/1984 | Japan | 271/9 |

*Primary Examiner*—Andres Kashnikow
*Assistant Examiner*—Matthew C. Graham
*Attorney, Agent, or Firm*—Shenier & O'Connor

[57] ABSTRACT

A sheet dispenser for selectively dispensing predetermined numbers of sheets, for example, paper currency of different denominations and having plural input stations each receiving a stack of each bill denomination. A feed roller at each station has a high friction surface portion which engages a bottom sheet and feeds the sheet between the feed roller and a cooperating stripper shoe to assure single sheet feeding. An elongated acceleration belt extends beneath all of the feed rollers. Cooperating acceleration pinch wheels form a nip with the belt for accelerating a sheet entering the nip. A curved resilient guide cooperates with each feed roller to guide sheets passing the stripper shoe toward its associated acceleration nip. The sheets pass along the acceleration belt and outfeed stacker including a stacker wheel to facilitate the formation of a neat stack of sheets. Sensors detect the entry of a sheet into each acceleration nip and to assure proper positioning of the feed roller. Notches provides in each feed roller adjacent to the leading edge of the high friction surface assure movement of the leading edge of the sheet into the nip formed by the feed roller and stripper shoe to enhance sheet feeding. The drive motor for each feed roller rotates one revolution for each sheet to be dispensed. A microprocessor-based electronic control operates the motors to dispense a mix of denominations to preferably minimize the number of bills dispensed. An override is provided to alter the mix of the denominations. In the event that a sensor fails to sense the delivery of a bill to its associated acceleration nip the dispensing operation may be automatically repeated at least once.

19 Claims, 26 Drawing Figures

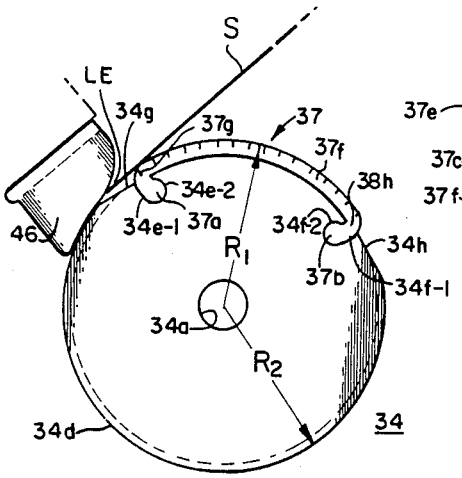
FIG. 3
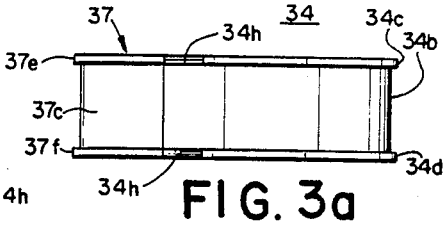
FIG. 3a
FIG. 3b
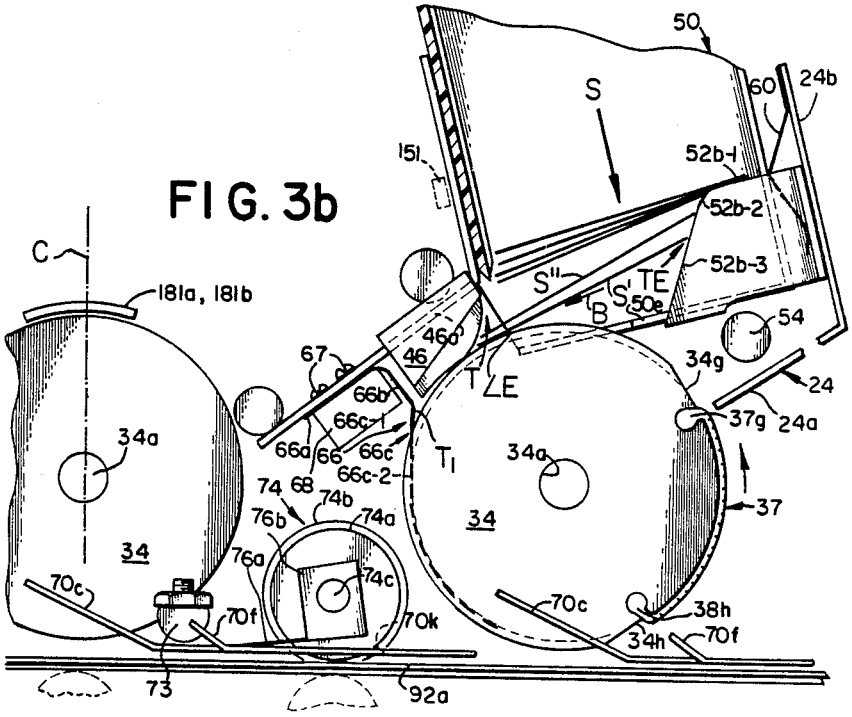

FIG. 4a
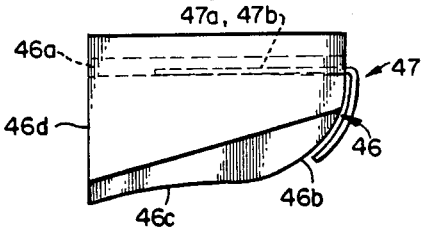
FIG. 4b
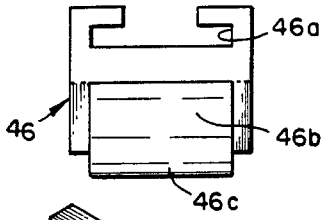
FIG. 4c
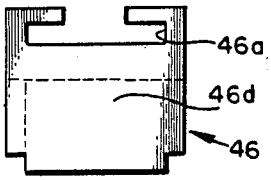
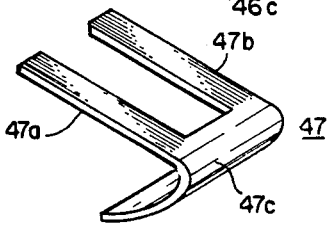
FIG. 4d
FIG. 5
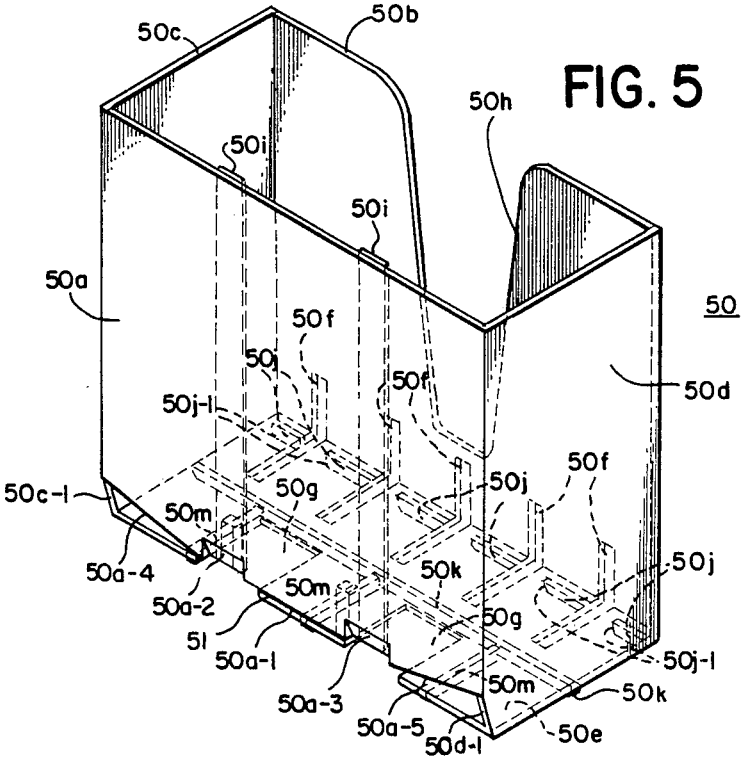

FIG. 6b
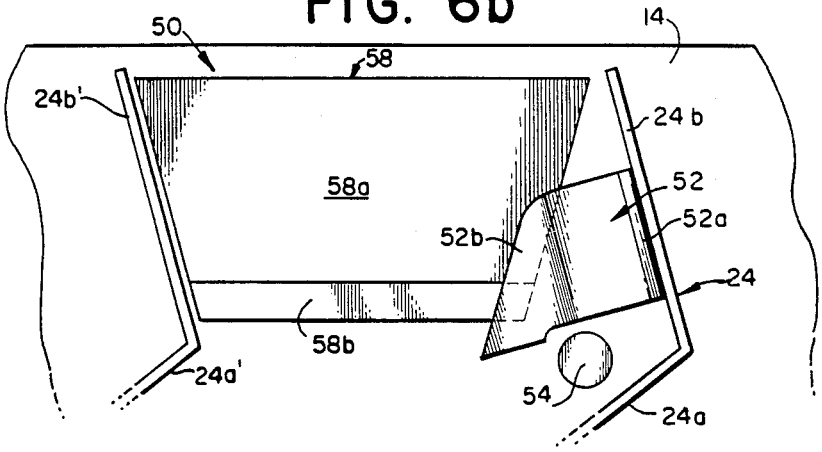
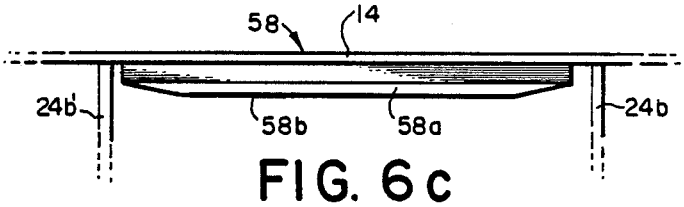
FIG. 6c
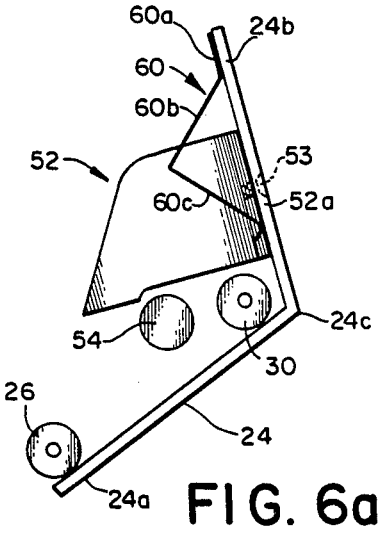
FIG. 6a

COMPACT APPARATUS FOR DISPENSING A PRESELECTED MIX OF PAPER CURRENCY OR THE LIKE

FIELD OF THE INVENTION

The present invention is a divisional of application Ser. No. 06/699044, filed 4/7/85, now U.S. Pat. No. 4,660,822, issued on 4/27/87 and it relates to sheet dispensers and more particularly to a novel sheet dispenser for dispensing a predetermined mix of different sheets each arranged within one of a plurality of input locations within the dispenser for dispensing the preselected mix of sheets to a common output location, at high speed.

BACKGROUND OF THE INVENTION

A number of applications exist where it is desireable to automatically and at high speed provide a preselected mix of sheets having differing chracteristics. For example, banks conventionally cash checks for customers by providing an appropriate mix of paper currency whose sum equals the sum of the amount recited on the check. As another example, in a commercial or business transaction, a purchase of an item may be made by payment in a bill of a denomination greater than the amount of the purchase necessitating that the commercial establishment provide the purchaser with a predetermined mix of paper currency whose sum represents the difference between the purchase price and the paper currency received from the customer.

The above transactions are typically performed manually which, in addition to being a slow and tedious process, also necessitates that, the teller (in the case of a bank) or sales person (in the case of a retail establishment) perform an important mental calculation to be assured that the amount of currency is correct and further to count the bills making up the currency mix. Even the slightest distraction can be sufficient to effect the accuracy of the count, to the detriment of either the payer or payee.

It is therefore desireable to mechanize this process to the greatest practicable extent.

BRIEF DESCRIPTION OF INVENTION

The automatic dispenser of the present invention is characterized by comprising a compact dispensing apparatus for dispensing automatically and at high speed a preselected mix of paper currency with the individual bills making up the currency mix being delivered to a common output stacker which stacks the currency mix in a neat and compact fashion.

A stack of each denomination of bills is placed within an input station having dispensing means which, due to its unique and yet simple design, eliminates the need for feed components otherwise employed in conventional apparatus thereby further simplifying the overall design and further enhancing the compactness of the dispenser.

Each input location includes a support surface for supporting a stack of bills of the appropriate denomination. A feed roller associated with each input location extends through an opening in the downstream end of the support surface and its annular periphery is provided with a high friction surface portion (hereinafter feed portion) which drives the bottom sheet in the forward feed direction as the feed portion engages the bottom sheet. A stripper shoe forms a nip with the feed roller which permits only single sheets to pass the aforesaid nip.

Each feed roller is provided with a notch or step portion immediately adjacent the leading edge of the feed portion to assure advancement of the leading edge of the bottom sheet into said nip before the leading edge of the feed portion passes beneath the stripper shoe.

Each feed roller has an annular recess arranged intermediate its side surfaces. The stripper shoe is positioned sufficiently close to said recess to urge the sheet passing therebetween into a curved contour which serves to stiffen the sheet thereby greatly enhancing the sheet handling operation.

An elongated acceleration belt is positioned beneath all of said feed rollers and extends between said feed rollers and an output location for advancing each sheet reaching the acceleration belt to the output station. An acceleration pinch wheel is positioned downstream of its associated feed roller and cooperates with the acceleration belt, forming an acceleration nip which abruptly accelerates a sheet as its leading edge enters the acceleration nip. A curved resilient guide cooperates with its associated feed roller for guiding a sheet passing beneath the stripper shoe about the feed roller and toward the associated acceleration nip.

Separate drive means are provided for each feed roller for driving each feed roller through one revolution for every bill to be dispensed. The drive means is controlled to position the feed portion so that the feed portion is displaced from both the bottom of the sheet stack and the acceleration belt when at rest and in readiness for dispensing the next sheet. Each motor is controlled to abruptly halt its associated feed roller so that the distance between the leading edge and the opening in the stack supporting surface is sufficient to assure that the feed roller has sufficient time to be accelerated to the proper dispensing speed when its leading edge engages the bottom sheet in the input location.

The remaining portion of each feed wheel periphery has a low friction surface which is incapable of advancing a sheet from the input location.

The drive means for each feed roll is preferably a stepper motor. The feed roller shaft includes a pin which cooperates with a home position sensor to interrupt the light directed to the sensor when the pin is in the home position. The stepper motor is controlled to halt the feed roller in the home position in readiness for a subsequent dispensing operation.

Sheet sensors are provided at spaced intervals along the acceleration belt run to assure that a sheet has been advanced to the associated acceleration nip as a result of the rotation of the feed roller.

The feed rollers of the dispensing devices are arranged in tandem fashion, whereby sheets from the dispenser further removed from the output stacker pass beneath the next dispenser closre to the output. The sensor associated with the feed roller closest to the output stacker serves the dual function of assuring that sheets dispensed from its associated input location have reached the associated acceleration nip and further to assure that sheets from those input locations successively more remote from the output location have passed beneath the last mentioned sensor.

The output stacker section comprises at least one stacker wheel and cooperating stack support plate which strips sheets delivered to stacker wheel pockets from the stacker wheel and neatly stacks the bills collected thereon. The stacker wheel is driven through a drive chain which includes a motor and cooperating pulley means for driving the acceleration belt and gear means arranged between the downstream end of the belt run and the stacker wheel for rotating the stacker wheel. The acceleration belt is supported by a platform including drive and driven rollers and idler pulleys arranged on an acceleration belt platform. The platform is moveable to an inoperative position displaced from the feed wheels for inspection and maintenance purposes. The engaging gears for imparting drive from the acceleration belt to the stacking wheel are disengaged when the belt support platform is moved to the displaced position thus rendering the stacker wheel inoperative at that time.

The output stacking section may be modified to suit the output delivery needs of the particular application.

The acceleration pinch wheels may each be mounted to that its axis of rotation is common with the axis of rotation of its associated feed roller. The acceleration belt is arranged immediately beneath the aforementioned coaxially mounted idler roller to form the accleration nip with the pinch roller and impart rotation thereto.

The stack of each denomination of bills is preferably arranged within a cassette which is releaseably received by each input station thereby enabling off-line replacement of currency into the cassette and preferably providing placement of a precounted quantity of paper currency. The cassettes may be strapped preparatory to insertion into an input location to facilitate their movement and handling.

Resilient spring means, cooperating with guide means forced fittingly receive and position a cassette to accurately locate the cassette and hence the stack of currency therein in the proper position for dispensing. The cassettes are so configured relative to the input location to prevent improper orientation of a cassette within an input location. The cassettes may also be colored coded to represent each denomination and may further be keyed to prevent a cassette from being inserted in other than its proper denomination input slot.

The dispenser is preferably provided with a security cover having a lock to secure the currency contained therein during the time that the equipment is unattended.

Due to the novel, modular design, it is a simple matter to provide dispensing equipment with a greater or lesser number of input locations without significant changes in overall design. Control of the dispensing apparatus is provided by a microprocessor based controller which preferably has a set program for dispensing that mix of paper currency which constitutes the smallest total number of bills whose denominations total up to the desired amount. However, an override is provided to enable the operator to dispense a different denominational mix chosen, for example, at the option of the patron. In the event that the rotation of a feed roller fails to deliver a sheet to its associated sensor, the controller will attempt to perform at least one additional dispensing operation and, if the faulty condition persists, dispensing will be halted pending correction of the fault condition.

OBJECTS OF THE INVENTION AND BRIEF DESCRIPTION OF THE FIGURES

It is therefore one object of the present invention that provide a novel compact dispensing apparatus for dispensing a preselected mix of sheets delivered from a plurality of input locations.

Another object of the present invention is to provide a dispenser for dispensing a predetermined mix of paper currency of different denominations in which the input and dispensing locations are of a novel, uniform, modular design, thereby simplifying the overall design of the apparatus.

Still another object of the present invention is to provide a novel feed mechanism for use in dispensing apparatus for dispensing a preselected mix of different paper sheets and incorporating a novel feed roller at each input location and drive means therefore.

Still another object of the invention is to provide novel dispensing apparatus for dispensing a preselected mix of paper sheets of different characteristics in which the sheets are stacked in cassettes releaseably insertable into each input location which incorporates cooperating guide means for accurately positioning and supporting the cassette to assure proper handling of the sheets.

Still another object of the present invention is to provide a novel compact dispensing apparatus incorporating a plurality of individual dispensers of modular design cooperating with a common acceleration drive means for delivering dispensed sheets from each input location to a common output location.

Still another object of the present invention is to provide novel dispensing apparatus incorporating a microprocessor based controller for automatically determining the preselected mix of paper sheets and including means for altering said mix.

Still another object of the present invention is to provide novel dispensing apparatus incorporating a microprocessor based controller for automatically determining a preselected mix of paper sheets and including means for altering said mix and wherein said controller controls the drive motors for each feed roller to accurately position each feed roller in accordance with home position sensing means.

Still another object of the present invention is to provide a novel dispensing device including a microprocessor based controller cooperating with sensor means for assuring that the operation of each feed roller has resulted in the delivery of a sheet from its associated stack and further to assure that each sheet has reached the output location.

The above as well as other objects of the present invention will become apparent when reading the accompanying description and drawing in which:

FIGS. 1*a*, 1*b* and 1*c* show a side elevation, top plan and end elevation views respectively of a dispenser designed in accordance with the principles of the present invention.

FIG. 1*d* is a partially sectionalized view showing a portion of the dispensing apparatus of FIGS. 1*a*–1*c* looking in the direction of arrows 1*d*–1*d*.

FIGS. 2*a* and 2*b* are side and end views of the stepper motor and mounting shown in FIG. 1*c*.

FIG. 3 shows an enlarged view of one feed roller employed in the dispenser shown in FIGS. 1*a* through 1*c*.

FIG. 3*a* shows an end view of the feed roller of FIG. 3.

FIG. 3*b* is an enlarged detailed view of the feed roller, stripper and part of a cassette employed by each individual dispensing device.

FIGS. 4*a*, 4*b* and 4*c* are front, rear and side views of the stripper shoe of FIG. 3*b*.

FIG. 4*d* is a perspective view of a sheet guide for use with the stripper shoe of FIGS. 4*a*–4*c*.

FIG. 5 is a perspective view of a cassette employed in each dispensing device.

FIGS. 5*a* through 5*d* show top, bottom and three different side views of the cassette of FIG. 5.

FIG. 6 is a perspective view of a cassette guide and currency support member.

FIG. 6*a* is a detailed view of one currency support plate and currency support member.

FIGS. 6*b* and 6*c* show a top view and a side elevation of the side guides for guiding a cassette into a cassette receiving cavity.

Figure 1A:
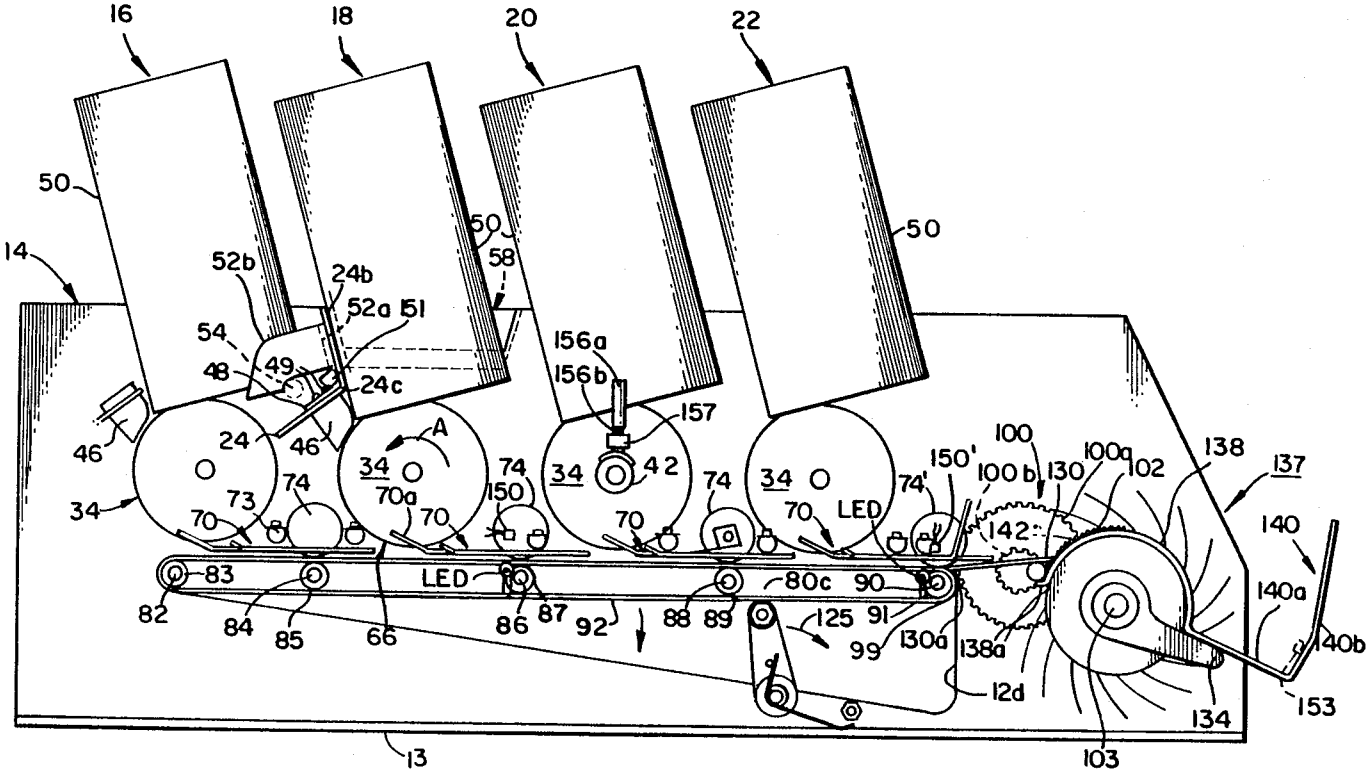
Figure 1B:
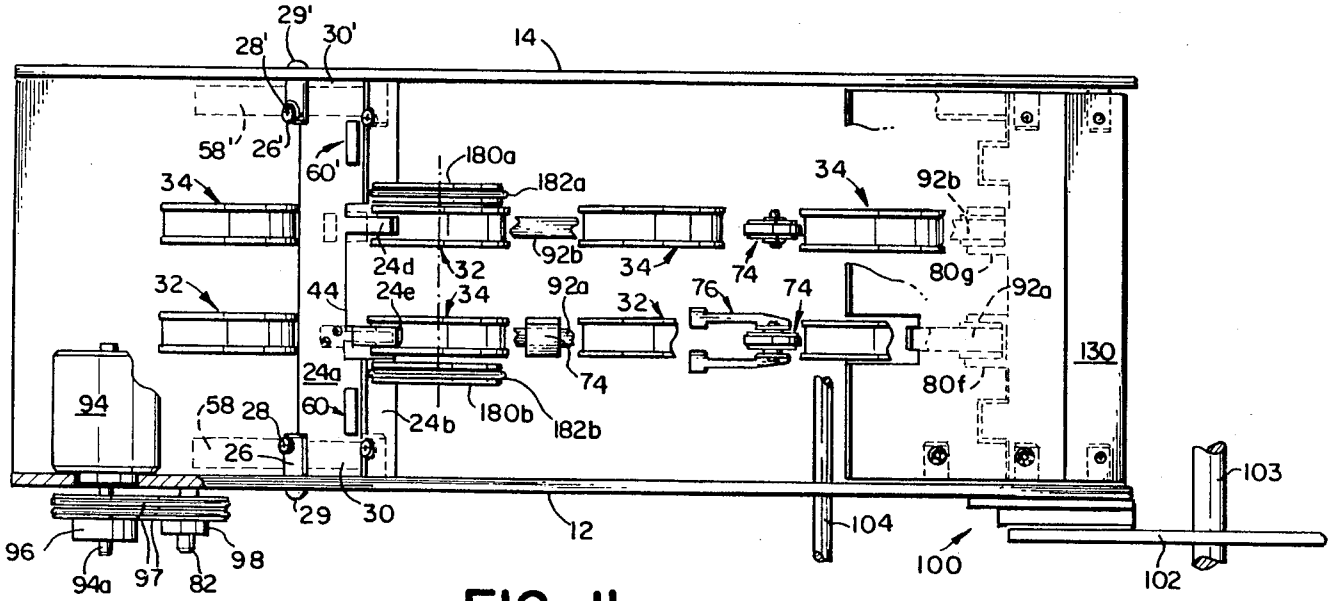
Figure 1C:
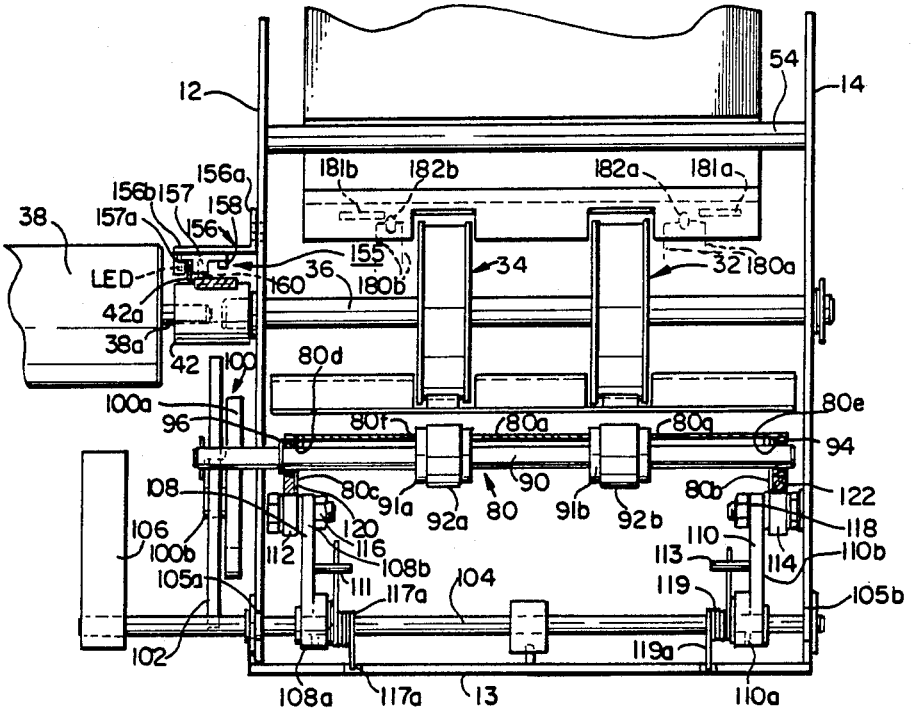
Figure 8:
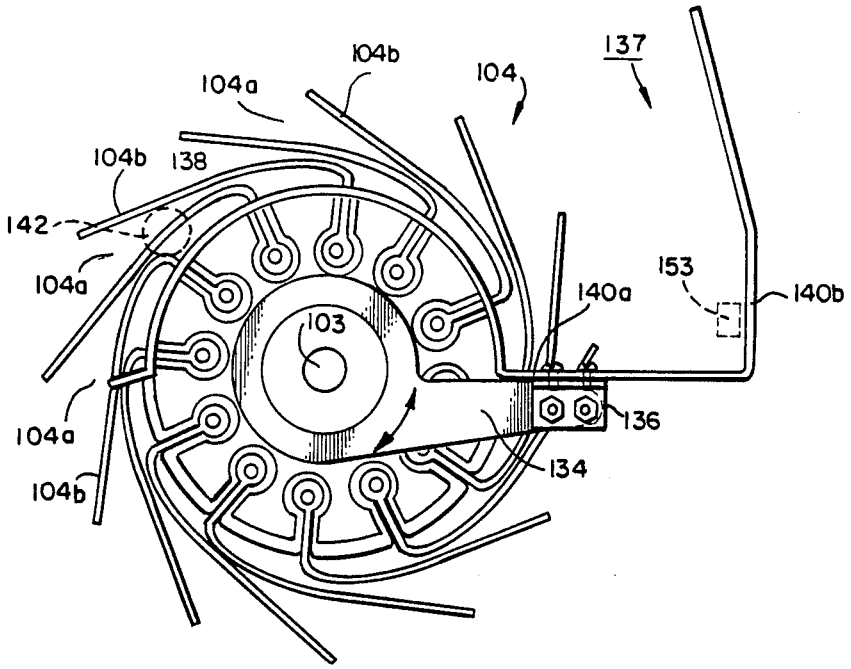
FIG. 8 is a detailed view of the stacker wheel and output stacker of FIG. 1*a*.
Figure 8A:
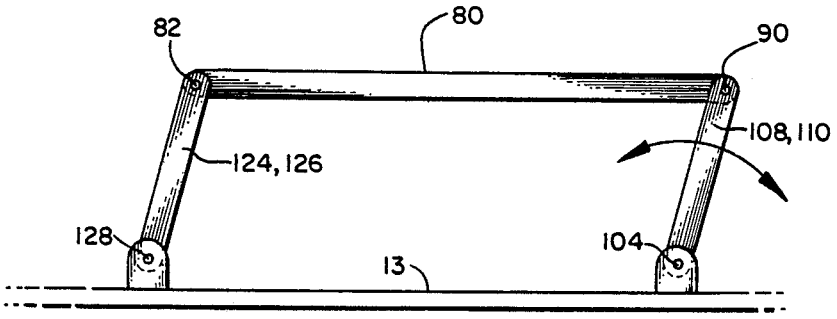

FIG. 8*a* is a simplified view of a parallelogram linkage for the acceleration belt supporting platform of FIGS. 1*b* and 1*c*.

Figure 9:
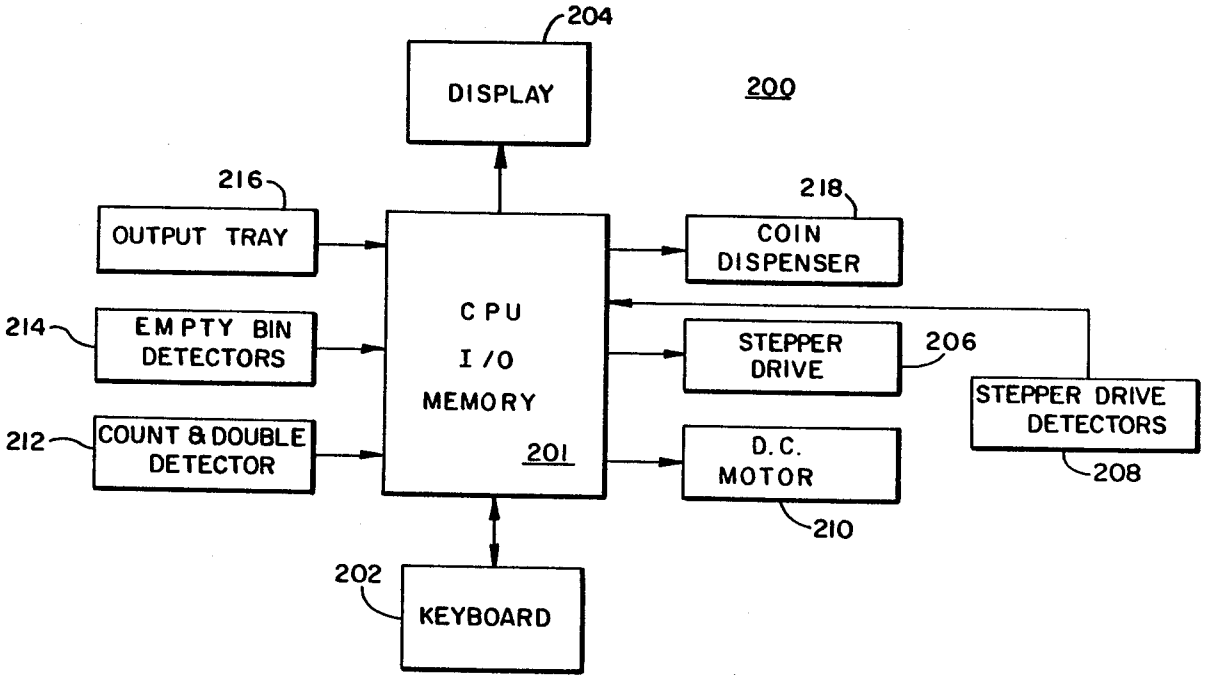

FIG. 9 is a block diagram of the control electronics for the dispenser of FIGS. 1*a*–1*c*.

DETAILED DESCRIPTION OF THE INVENTION

FIGS. 1*a* through 1*c* show a dispenser 10 designed in accordance with the principles of the present invention and comprised of a pair of side plates 12 and 14 each supporting a plurality of feeder/stripper assemblies provided at each input location 16, 18, 20 and 22.

Each input location is provided with a plate such as for example the plate 24 shown in detail in FIGS. 1*a* and 1*b*, which plate is secured to the vertical side plates 12 and 14 by a plurality of cylindrical posts such as for example the posts 26, 26′ each having a diametrically aligned opening for receiving a fastener 28 28′ and having an axially aligned tapped opening for receiving a fastener 29, 29′. Fasteners 29, 29′ secure posts 26, 26′ to side plates 12 and 14. Fasteners 28, 28′ threadedly engage tapped openings in plate 4 to secure plate 24 to posts 26, 26′ and hence the side plates 14. Similar posts 30, 30′ shown in dotted fashion cooperate with posts 26, 26′ to rigidly secure plate 24 to side plates 12 and 14 to prevent plate 24 from experiencing any rotational movement.

Each input location 16–22 is comprised of a pair of feed rollers and cooperating stripper shoes. The stripper shoes and feed rollers of only one such location will be described herein for purposes of simplicity, it being understood that the remaining input locations 16, 20 and 22 are substantially identical in both design and in operation.

Figure 2A:
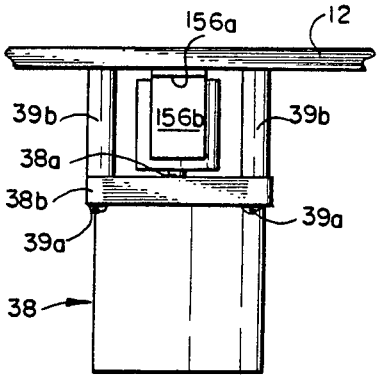
Figure 2B:
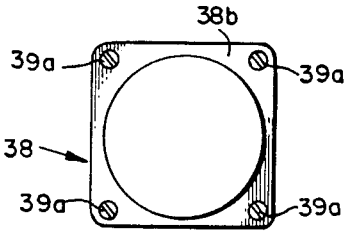

Input location 18 is comprised of a pair of feed rollers 32, 34 locked to rotate upon a common shaft 36. Shaft 36 is journalled within suitable bearings provided in side plates 12 and 14 and extends beyond side plate 12. A motor 38, which is preferrably a stepper motor, is secured to side wall 12 by fasteners 39*a* arranged at each corner of the stepper mounting flange 38b. Fasteners 39*a* extend through cylindrical spacers 39*b* and are secured to side plate 12, as is shown in FIGS. 2*a*, 2*b*. Output shaft 38*a* of motor 38 is coupled to shaft 36 by coupler 42. Stepper motor 38 is electrically coupled to the electronic controller 200 (FIG. 9) for precisely controlling the rotation of the pair of feed rollers 32, 34. One such feed roller 34 is shown in detail in FIGS. 3 and 3*a* and is, in one preferred embodiment, comprised of a cylindrical shaped roller having a central opening 34*a* for receiving shaft 36. The cylindrical periphery of the feed roller is provided with a shallow recess 34*b* forming a pair of continuous flanges 34*c*, 34*d*. The roller 34 is preferably formed of a plastic material having a low coefficient of friction. The annular surfaces of the flanges 34*c*, 34*d* and groove 34*b* are smooth.

The feed roller 34 is provided with a pair of radially aligned recesses arranged at spaced intervals about the roller and provided with narrow recess portions 34*e*-1, 34*f*-1 which communicate with enlarged substantially circular shaped openings 34*e*-2, 34*f*-2.

Insert 37 is formed of a material having a high coefficient of friction and is formed for example of urethane have a durometer of the order of 60. Insert 37 has enlarged beaded end portions 37*a*, 37*b* which are received within enlarged recess portions 34*e*-2, 34*f*-2 so as to be lockingly received upon roller 34. The surface of insert 37 is provided with a shallow recess 34*c* which conforms with the recess 34*b* in roller 34, to form flanges 37*e*, 37*f* which are aligned with flanges 34*c*, 34*d* as shown best in FIG. 3*a*.

The radial distance R1 from the center of feed roller 34 to the outer periphery of the flanges 34*e*, 34*f* is substantially constant and is preferably substantially equal to the radial distance R2 between the center of roller 34 and the outer periphery of flanges 34*c*, 34*d*. As a practical matter, the radial distance R1 may differ within a tolerance of 10 to 15 thousandths of an inch relative to the radial distance R2. The feed roller is provided with a pair of cut-away portions 34*g*, 34*h* adjacent to the corners 37*g*, 37*h* of insert 37 which corners are defined by the arcuate intermediate portion of insert 34 and the radially aligned portions 37*a*, 37*b* of insrt 37. The cut-away portions 34*g*, 34*h* define abrupt reduced portions of the feed wheel 34 which enable the leading edge LE of at least the bottom sheet S′ in the input location to drop into the entrance throat region formed by flat surface 34*g* and a cooperating stripper shoe 44 to assure proper and positive feeding of a sheet by the feed wheel insert 37, as will be more fully described hereinbelow.

Plate 24 has a first diagonally aligned plate portion 24*a* and a second diagonally aligned portion 24*b* integrally joined to portion 24*a* along bend line 24*c*. The central portion of plate portion 24*a* is cut away to define a pair of diagonally aligned projections 24*d*, 24*e* each of which slideably receive a stripper shoe 46 shown also in FIGS. 4*a*–4*c* and formed of a resilient, rubber-like material, for example urethane, having a coefficient of friction which is less than the coefficient of friction of insert 37 and which is significantly greater than the coefficient of friction of feed roller 34. The stripper shoe is provided with a substantially diagonally aligned stripper surface having a first convex surface portion 46*b* followed by a concave surface portion 46*c*. Elongated opening 46*a* slidably receives projection 24*d*. A stop plate 48 is adjustably mounted behind each projection 24*d*, 24*e* by fasteners 49 such that the right hand edge of stop plate 48 engages the rear surface 46*d* of stripper 46 to adjust the position of stripper 46 relative to its associated feed roller. Each stripper shoe 46 is mounted upon an associated projection 24d, for example. The direction of rotation of each feed roller, which is counterclockwise as shown in FIG. 1*a*, serves to normally maintain the associated stripper shoe upon its projection with movement of the stripper shoe downward and to the left being limited by stop plate 48.

The stripper surface of each stripper shoe is positioned above the annular recess of an associated feed roller which is collectively comprised of recesses 34b and 37c shown in FIG. 3a. The stripper surface is preferably at least flush with the peripheries of flanges 34c, 34d and 37e, 37f to urge a sheet passing therebetween into an undualting shape which tends to stiffen the sheets. The stiffening of the sheets enhances the feeding and stripping operation. The flanges 37e, 37f are provided with slots 39 to improve the frictional engagement with a sheet.

A curved metal plate 47 as shown in FIGS. 42 and 4d having arms 47a and 47b which slide into the slot 46a in shoe 46 provides a smooth, low friction curved surface 47c to aid in the feeding of the leading edges of curled sheets beneath the stripper shoe.

Each input location is adapted to receive a cassette 50 for receiving and supporting a large stack of sheets. In the preferred embodiment which is adapted for handling U.S. paper currency, a cassette can accommodate 500 bills.

Figure 5A:
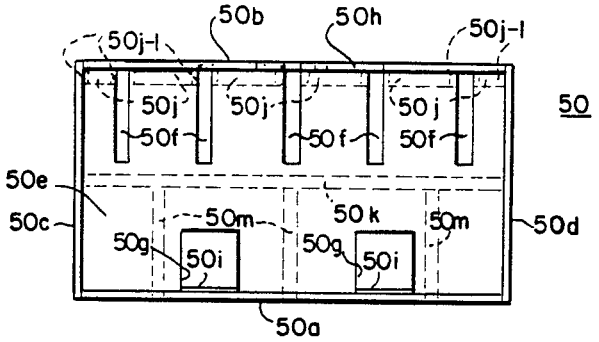
Figure 5B:
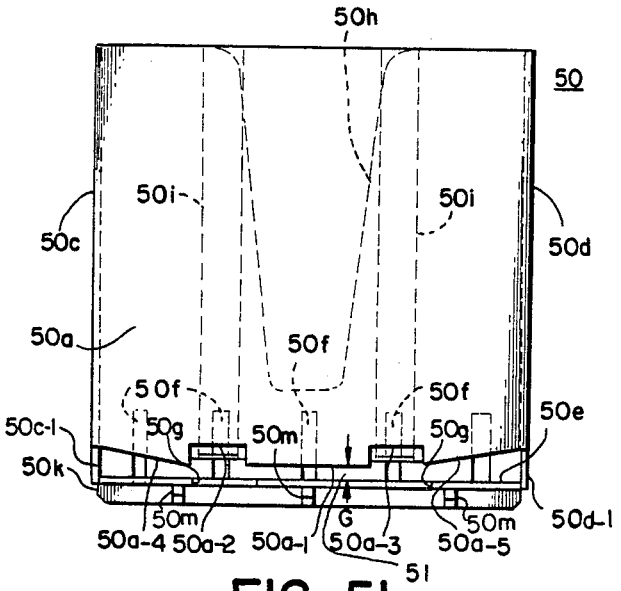
Figure 5C:
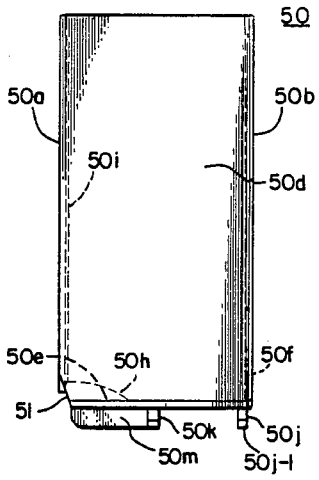
Figure 5D:
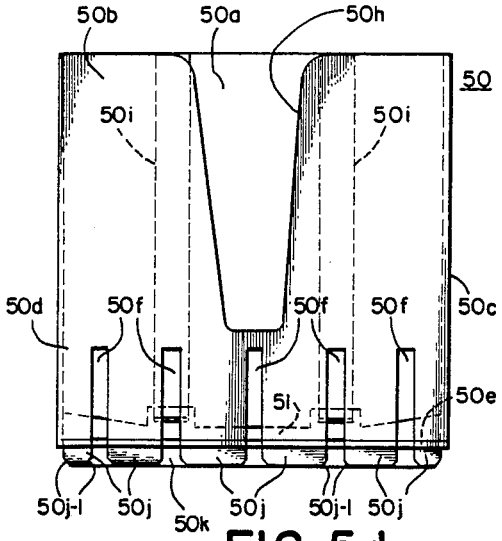

One such cassette will be described herein for purposes of simplicity, it being understood that the remaining cassettes are substantially identical in both design and function. Considering FIGS. 5 through 5d, the cassette 50, which is preferrably molded from a suitable plastic material, comprises front and back walls 50a and 50b, side walls 50c, 50d and floor 50e. A plurality of L-shaped slots 50f are arranged at spaced intervals from one another and have vertical or upright portions formed in front wall 50b and horizontal or bottom slot portions formed in floor 50e. L-shaped slots 50f serve as guide means to assure proper insertion and alignment within an input location, as will be more fully described.

A pair of square shaped notches 50g are cut into floor 50e an extend inwardly from the rear edge thereof. The slots 50g enable each of the feed rolls 32, 34 to extend upwardly and into the bottom portion of the cassette 50 when it is in the operative position, to facilitate a sheet feeding operation.

Front side wall 50b is provided with a tapered, elongated slot 50h to facilitate insertion and removal of sheets into the cassette. A pair of elongated strips 50i are provided along the interior surface of rear wall 50a to maintain the leading edges of sheets stacked within cassette 50 a spaced distance away from the interior surface of rear wall 54a thus limiting the area of engagement of the leading edge of each sheet to the width of strips 50i. The exposed surfaces of strips 50i are smooth to further reduce the frictional engagement between these strips and the leading edges of paper bills.

The lower rear corner of the cassette is cut away at an angle to form the beveled edges 50c-1, 50e-1 along side walls 50c and 50e, respectively. The bottom portion of rear wall 50a is cut so that its center portion 50a-1 lies a spaced distance above the interior surface of floor 50e. A pair of square shaped notches 50a-2, 50a-3 are arranged on opposite sides of lower edge 50a-1 and provide clearance for the adjacent end of an associated stripper shoe. The remaining bottom edge of front wall 50a is cut at an angle as shown at 50a-4, 50a-5. The lower end of rear wall 50a and the rear end of floor 50e are cut to form a clearance gap G shown in FIG. 5b to facilitate the bottom feed of sheets from cassette 50 by means of the cooperating pair of feed rollers and stripper shoes. When each cassette 50 is properly mounted within each input location, the two feed wheels extend through openings 50g in the floor 50e of cassette 50. Each cassette 50 is tilted in the manner shown in FIG. 1a to further facilitate the feeding of sheets.

Each input location is provided with guide assemblies for slidably receiving and retaining each cassette 50 within an associated input location.

Figure 6:
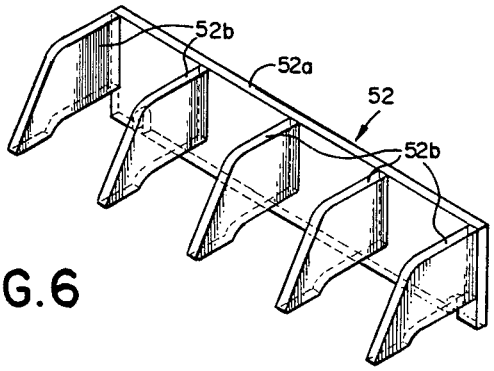

FIGS. 6, 6a, 6b and 6c show the guide means utilized for slidably receiving and accurately holding each cassette in the operative position in an input location. FIG. 6, for example, shows a currency support 52 comprised of a main body portion or plate 52a having a plurality of trapezoidal-shaped projections 52b integrally joined to plate 52a and arranged in spaced parallel fashion each to the other. There are four such guide supports 52 each one being arranged so that its main plate 52a is fastened to an associated plate portion 24b (see FIGS. 1a and 6a) and so that its bottom edge is positioned above an elongated rod 54 extending between side plates 12 and 14 and providing additional structural support for the apparatus 10.

Each plate 24 for input locations 18, 20 and 22 serves the dual function of aligning a cassette 50 engaging its right-hand surface and supporting a currency support 52 to guide a cassette 50 into position to the left of each plate 24.

The slots 50f in cassette 50 each slidably receive one of the projections 52b. This arrangement also prevents the cassette from being inserted when improperly oriented. A plurality of integral projections 50j extend downwardly from the forward end of floor 50e in cassette. Projections 50j serve to reenforce and enhance the structural strength of the cassette. In addition, the corners 50j-1 of projections 50j are beveled to facilitate guidance of projections 52 into each of the receiving slots 50f. Floor 50 is provided with additional reenforcing ribs for improving the structural strength of cassette 50, said reenforcing ribs including elongated rib 50k and shorter reenforcing ribs 50m.

A pair of cassette guide members 58, 58' are provided in each input location and are secured to side walls 12, 14 respectively as shown in FIGS. 1b, 6b and 6c. Each of the guide members is provided with a large diagonally aligned surface 58a which terminates in a flat, vertically aligned surface 58b along its lower end. The inwardly tapering surfaces 58a, 58a' provide a cassette receiving cavity between plates 12 and 14 and 24 which very gradually tapers thereby serving to guide the cassette 50 into its associated input location. The bottom portions of cassette side walls 50c, 50d engage the vertically aligned lower surface portions 58b, 58b' of guiding members 58, 58'. The engaging surfaces of cassette 50 and guiding members 58, 58' have low coefficients of friction to facilitate insertion and removal of the cassette.

A pair of V-shaped springs 60, 60' (note FIGS. 1b and 6a) have spring mounting portions 60a,60a' secured to the left hand surface of plate portion 24b. The diagonally aligned spring portion 60b and eventually the bend 60d is engaged by the adjacent edge of cassette 50 causing the angle formed by spring portions 60b, 60c at bend 60d to enlarge due to the entry of cassette 50 which causes the spring portion 60b, 60c to tend to "flatten" against side wall 24b, placing both springs 60, 60' in the charged condition. Springs 60, 60' urge a loaded cassette away from plate portion 24b and urge the exterior surface of cassette rear wall 50a against the right hand surface of the plate portion 24b' positioned to the left of the cassette 50 as shown best in FIG. 6b.

Before a cassette is loaded into an input location, the stack of bills within the cassette is arranged with each of the individual bills being substantially parallel to floor 50e. When the cassette is inserted into an input location, projections 52b of currency support bracket 52 urge the right hand end of the stack of sheets upwardly so as to tilt the entire stack of sheets within the cassette thereby increasing the angle which the bottom sheet forms with an imaginary horizontally aligned surface. The alignment of the bottom sheet due to currency support 52 enhances proper insertion and feeding of the leading edge of each sheet into the feeding and stripping nip formed between feed rollers 34 and cooperating stripper shoes 46. The feed operation is performed in the following manner:

Making reference to FIG. 3*b*, the leading edge 37g of insert 37 is oriented at a predetermined start (i.e. "home") position which is preferably at an angle of approximately 70°-90° from the opening in the floor 50e of cassette 50. It should be understood that both feed rollers 32, 34 and their cooperating stripper shoes 46, 46 operate in the identical manner and hence the description herein will be given for only one of the feed rollers and its cooperating stripper shoe.

The motor 38 coupled to shaft 34 is provided with a steep ramp signal to rapidly accelerate the feed roller to the desired dispensing speed. The linear speed at the surface of the feed roller is in a range of the order of 65 to 85 inches per second when the leading edge of insert 37 engages the bottom sheet S' in the stack S of sheets. The bottom sheet is moved in the direction shown by arrow B causing its trailing edge to move off the top surface 52b-1 of each projection 52b, along the curved portion 52b-2 and downwardly along the diagonally aligned portion 52b-3.

Before any of the sheets are moved by the feed roller inserts 37, substantially the entire surface portion of each major surface of a sheet is an engagement with the next adjacent sheet. When the leading edge 37g of the insert 37 engages the bottom sheet, the bottom sheet S' and typically several sheets immediately above the bottom sheet, are moved to the left due to the frictional engagement between insert 37 and the bottom sheet S' and due to the frictional engagement between and among the several sheets immediately adjacent the bottom sheet S'. As the trailing edge TE of bottom sheet S' moves downwardly along projections 52 the weight of the stack of sheets is removed from sheet S', greatly facilitating the feeding of this sheet. The leading edge 37g of insert 37 engages the bottom surface of bottom sheet S' a spaced distance to the right of its leading edge IE, driving the sheet S' in the direction shown by arrow B. The leading edge LE of the sheet S' starts to move into the tapered throat region T defined by the curved convex surface portion 46a of stripper shoe 46 and the periphery of feed roller 34. The cut away portion 34g of feed roller 34 allows the leading edge LE of bottom sheet S' to move well into the tapering entrance throat before the leading edge 37g of insert 37 beings to move into the tapering throat region T. The leading edge 37g of insert 37 then forces the bottom sheet S' initially against the convex curved surface portion 46a of stripper shoe 46. The coefficient of friction of insert 37 is greater than the coefficient of friction of the stripper surface of stripper 46 causing the insert 37 to be the dominant influence upon sheet S' whereupon sheet S' will be driven in the forward feed direction as it is moved by insert 37.

In the event that the feed operation causes the bottom sheet S' and the next adjacent sheet S'' to move between stripper shoe 46 and feed roller 44, the frictional engagement between insert 37 and bottom sheet S' is greater than the frictional engagement between the top surface of sheet S' and the bottom surface of sheet S'', causing sheet S' to move in the forward feed direction. The frictional force exerted by stripper shoe 46 upon the top surface of sheet S'' is greater than the frictional force exerted upon the bottom surface of sheet S'' by the top surface of sheet S' so that stripper 46 prevents sheet S'' from moving in the forward feed direction thus providing the desired stripping action to ensure that only a single sheet will pass downstream beyond the feed roller 34 and cooperating stripper shoe 46.

When the leading edge 37g of the insert is in the proper standstill (i.e. "home") position and the feed roller 34 undergoes acceleration, the edges of feed roller flanges 34c, 34d (see FIG. 3*a*) initially slidingly engage the surface of bottom sheet S'. The coefficient of friction of the surfaces of these flanges is sufficiently small to prevent the rotating feed roller from imparting any drive whatsoever to the bottom sheet. However, when the flanges 37e, 37f of insert 37 engage the bottom sheet, this sheet is driven towards the feed nip.

Each input location 16–22 is provided with a pair of curved resilient guides 66 each cooperating with an associated feed roller. Noting, for example, FIG. 3*b*, guide 66 has a mounting portion 66a resting against the underside of plate portion 24a and arranged between plate portion 24a and a mounting block 68. Fasteners 67 secure mounting portion 66a and mounting block 68 to plate 24. Guide 66 has a portion 66b bent about the forward end of mounting blocks 68 and an elongated curved portion 66c whose leading portion forms a tapering guideway T1 with feed roller 34. The remaining portion of guide 66 extends slightly into the recess portions 34b and 34c (see FIG. 3*a*). Portion 66c-2 of the guide member cooperates with the recess 37c in feed roller insert 37 to maintain the undulating shape of the sheet to faciliate the delivery of the sheet toward the acceleration assembly to be more fully described hereinbelow.

Each dispensing location 16 through 22 (see FIG. 1*a*) is provided with a sheet guiding plate 70 for mounting an acceleration pinch roller and a sensor, which plate 70 is secured to side walls 12 and 14 by pairs of posts 72, 73.

A central projection 70a and two side projections 70b, 70c are bent to extend diagonally upward in the manner shown in FIG. 3*b*. The inner ends of square-shaped notches 70d, 70e are provided with short, upwardly bent portions 70f, 70g. The free ends 66d of the guide springs 66 are positioned below the upwardly bent portions 70a, 70b and 70c and terminate a spaced distance from the flat central portion 70h of plate 70.

A pair of acceleration pinch wheels 74, 74 are arranged in alignment with square-shaped notches 70d and 70e and are each comprised of a roller 74a having an annular band of high friction material 74b. A supporting shaft 74c extends into openings provided in the arms of a mounting bracket 76 having a pair of leaf spring arms 76a whose left hand ends are secured to plate 70 by fastening means 77. The opposite ends of leaf spring arms 76a are bent upwardly to form a pair of upright arms 76b for receiving and supporting opposite ends of the pinch wheel shaft 74c. The spring mountings for rollers 74 position the rollers so that they extend at least partially through slots 70*j*, 70*k* in plate 70. Note roller 74 extending through slot 70*k* in FIG. 3*b*.

Each pinch wheel 74 cooperates with the upper run of an elongated acceleration belt 92*a*, 92*b* (see FIG. 1*c*), forming an acceleration nip which abruptly accelerates a sheet when its leading edge enters into a cooperating pair of acceleration nips.

Figure 1D:
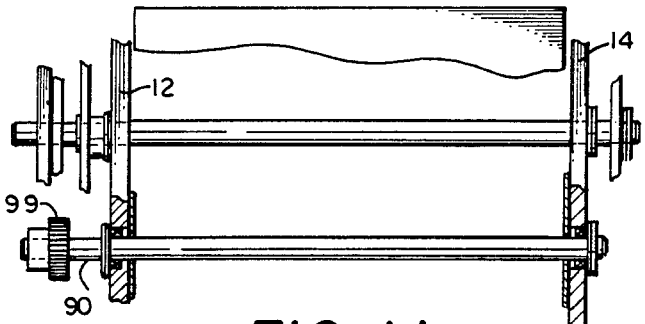

FIGS. 1*a*, 1*c* and 1*d* show the acceleration belt supporting platform 80 comprised of an elongated main flat portion 80*a* having elongated, integral, downwardly depending sides 80*b*, 80*c*. Each of said sides is provided with a plurality of openings for receiving roller supporting shafts. For example, elongated side 80*c* shown in FIG. 1*a* is provided with a plurality of openings 80*d* each respectively receiving a shaft 82, 84, 86, 88 and 90 for supporting associated pairs of rollers 83, 85, 87, 89 and 91. Note, for example, FIG. 1*c* which shows the pair of rollers 91 more specifically comprised of crowned rollers 91*a* and 91*b*. Shaft 90 is freewheelingly mounted to side walls 80*b* and 80*c* by bearings 94 and 96. Shaft 82 is also journaled within a similar pair of bearings (not shown for purposes of simplicity) arranged along side walls 80*b*, 80*c* and in alignment with a like pair of openings 80*d*, 80*e* and is further provided with a pair of crowned rollers 83*a*, 83*b*.

Shafts 84, 86 and 88 are rigidly secured to side walls 80*b* and 80*c* and have their roller pairs freewheelingly mounted to their associated shafts 84, 86 and 88.

Plate portion 80*a* is provided with a pair of rectangular shaped openings arranged above each shaft 82 through 90 to enable at least a portion of each of the pairs of rollers to extend upwardly through the aforementioned openings. Note, for example, FIG. 1*a* showing openings 80*f*, 80*g* provided in plate 80*a* through which the upper portions of crowned rollers 91*a*, 91*b* extend.

A pair of elongated flat belts 92*a*, 92*b* are entrained about each set of rollers. For example belt 92*a* is entrained about rollers 83*a*, 85*a*, 87*a*, 89*a* and 91*a*. The cylindrical idler rollers 85, 87*a* and 89*a* are each aligned beneath an associated acceleration pinch roller, with each pinch roller 74 forming a nip with the acceleration belt 92*a*. Acceleration rollers 74 are each likewise associated with rollers 83*b* through 91*b* which support acceleration belt 92*b* with each pair of belts and associated pairs of acceleration pinch rollers forming a pair of acceleration nips each adapted to accelerate a sheet fed into the pair of acceleration nips from the associated input location. For example, considering input location 18, the bottom sheet feed from the cassette 50 provided at this input location undergoes cooperating feeding and stripping action to assure that only the bottom sheet passes the stripper shoes 46, is guided between feed roller 32, 34 and spring guides 66 (see FIGS. 1*a* and 3*b*), moves beneath bent portion 70*a* of plate 70 and advances to the acceleration nips formed between the acceleration belts 92*a*, 92*b* and the cooperating acceleration pinch wheels 74 (note FIGS. 1*a*, 1*b* and 3*b*).

When the leading edge of a sheet from the input location 18 enters the aforementioned acceleration nips, the sheet is accelerated, preferably to a linear speed of the order of 100 inches per second. The sheet passes through the aforementioned nips and successively advances through the pairs of acceleration nips associated with each of the input locations 20, 22. Thus each pair of acceleration nips serves as a means for accelerating each sheet delivered thereto from its associated input location, as well advancing to the output stacker each sheet delivered thereto from input locations further upstream relative to each acceleration nip. More specifically, sheets delivered from input location 22 pass only through one pair of acceleration nips which occupy the position immediately above crowned rollers 91*a*, 91*b*. A sheet delivered from input location 20, however, undergoes acceleration through the acceleration nips positioned above the pair of rollers 89 and further passes through the last pair of acceleration nips arranged at the extreme downstream position. In a similar fashion, sheets delivered from input locations 18 and 16 respectively pass through three and four pairs of acceleration nips. The spacing between pairs of successive acceleration nips is less than the length of a sheet measured in the feed direction to assure positive feeding of sheets.

As was mentioned hereinabove, idler rollers 74 are driven by the associated acceleration belts 92*a*, 92*b*, which belts are driven by motor 94 (see FIG. 1*b*). A pulley 96 is mounted on motor output shaft 94*a*. A pair of resilient O-rings 97 are entrained about pulley 96 and a cooperating pulley 98 mounted upon shaft 82. As was mentioned hereinabove, shaft 82 is freewheelingly mounted to sidewalls 80*b*, 80*c* and has its pair of rollers 83 secured thereto. Thus rotation of shaft 82 is imparted to the pair of rollers 83 mounted thereon which in turn move belts 92*a*, 92*b*. The crowned rollers 83*a*, 83*b* and 91*a*, 91*b* retain the belts 92*a*, 92*b* on the rollers. Gear 99 is mounted upon shaft 90 and engages large diameter idler gear 100*a* of gear assembly 100 having an integral small diameter gear 100*b* which engages a stacker gear 102 (see FIG. 1*a*) for rotating the shaft 103 upon which the stacker wheel 104 is mounted.

Side plate 12 is provided with an elongated, trapezoidal-shaped opening 12*d*. A shaft 104 (see FIGS. 1*a* and 1*c*) is journaled within bearing 105*a*, 105*b* in side walls 12 and 14 and extends beyond side wall 12. An operating handle 106 is secured to the left hand end of shaft 104 for lifting and lowering the acceleration belt platform 80.

The lower ends 108*a*, 110*a* of levers 108 and 110 are secured to shaft 104 and support a pair of freewheeling rollers 112, 114 by means of pins 116, 18 mounted at their upper ends 108*b*, 110*b* respectively. These rollers rollingly engage members 120, 122 provided along the lower exterior sides 80*b*, 80*c* of acceleration belt support tray 80. By rotation of operating handle 106 in the clockwise direction shown by arrow 125 in FIG. 1*a*, arms 108 and 110 are lowered causing the right hand end of tray assembly 80 to be lowered to dotted line position 80'. The reverse operation raises the tray to the operating position. Torsion springs 117, 119 have arms 117*a*, 119*a* arranged in openings in floor 13 and have their ends 117*b*, 119*b* engaging pins 111, 113 in levers 108, 110 to bias tray 80 toward the operative position.

FIG. 8*a* is a simplified diagram showing an alternative arrangement in which levers 108, 110 and an additional pair of levers 124, 126 have their lower ends mounted to shafts 104, 128 and have their upper ends pivotally receiving shafts 82, 90 (note also FIG. 1*a*).

The arrangement shown in FIG. 8*a* comprises a conventional parallelogram linkage which permits tray 80 to be lifted and lowered while retaining its horizontal orientation. This arrangement facilitates inspection maintenance and repair along the entire length of the acceleration assembly, as compared with the tray arrangement shown in FIG. 1*a*.

When the tray 80 is lowered, either through the arrangement shown in FIG. 1*a* or in FIG. 8*a*, gear 99 (see FIG. 1*d*) is disengaged from idler gear 100 (see FIG. 1*a*) to prevent operation of the stacker wheel when the acceleration belt support tray 80 is lowered to the operative position. In a similar fashion to the gear arrangement 99, 100, 102, the pulleys 96 and 98 and O-rings 97 (shown in FIG. 1*b*) may be replaced by a cooperating drive gear mounted on shaft 94*a*, and a driven gear mounted on shaft 82, with or without an intermediate idler gear similar to gear 100 (not shown for purposes of simplicity) for disengaging the drive motor from the acceleration belt when the acceleration belt support tray is lowered to the inoperative position.

A guide plate 130 (see FIGS. 1*a* and 1*b*) is positioned immediately adjacent the right hand end of the acceleration belt support tray 80 and has its left hand end 130*a* notched in the manner shown best in FIG. 1*b* to cooperate with plate 80 and assure that sheets are guided along the top surface of guide plate 130 and into a curved pocket 104*a* defined by an adjacent pair of curved flexible stacker wheel blades 104*b*. The stacker gear 102 is mounted upon shaft 103 together with stacker wheel 104 and engages the smaller diameter gear 100*b* which is an integral part of the idler gear 100, whose integral larger diameter gear 100*a* engages gear 99 on shaft 90 (see FIGS. 1*a* and 1*d*).

A pair of arms 134 are freewheelingly mounted upon shaft 103 and are each provided with angle brackets 136 which cooperate to support an output stacker 137 comprised of a curved guide plate 138 and an integral output stacker portion 140 comprised of output stacker floor portion 140*a* and end plate portion 140*b*. Stacker blades 104*b* extend through an elongated substantially rectangular shaped slot in curved plate 138 and formed curved pockets 104*a* which carry the sheets about a curved path to advance the leading edge of each sheet to floor plate 140*a* where the leading edge engages the floor plate and is stripped from the pocket 104*a* which carried the sheet to the output stacker, as is conventional. The left hand end 138*a* of curved plate 138 (see FIG. 1*a*) engages a limit pin 142 which limits swingable movement of the output stacker 137 in a clockwise direction and maintains the output stacker in the proper stacking position. Output stacker 137 may be lifted, i.e. moved in the counterclockwise direction, to remove sheets or the like from the region beneath the output stacker 137 and stacker wheel 104 or for purposes of maintenance and inspection. The gear train comprised of gears 99, 100 and 102 preferably provides a reduction in the range from 16 to 1 to 20 to 1 to provide the proper stacker wheel RPM.

Each input location dispensing assembly 16–22 is provided with a cooperating light source (LED) and light sensor 150. Each light sensor is mounted upon acceleration pinch wheel support plate 70 (see FIG. 7) which is provided with an opening 70*m*. Sensor 150 is mounted upon plate 70 and opening 70*m* is provided to receive light emitted from an associated LED. Each LED is mounted to the underside of the acceleration belt support tray 80*a* which is similarly provided with an opening (not shown for purposes of simplicity) to permit light from each LED to pass upwardly where it is directed towards its associated sensor 150. If desired, the positions of the LEDs and sensors 150 may be reversed. In addition, the LEDs and sensors may be moved further upstream so as to coincide with an imaginary vertical centerline C shown in FIG. 3. This arrangement is preferred when using the idler wheels 180*a*, 180*b* to be more fully described.

The opeation of the stepper motor 38 for driving the feed rollers of its associated input location initiates a dispensing operation.

The sensor 150 for the associated input location is examined a predetermined time interval after initiation of rotation of the pair of feed rollers 32, 34 for that input location. Each sensor 150 serves the dual function of assuring the delivery of a sheet and further measures the density of a sheet to be assured that it is a single sheet and not two or more overlapping sheets.

Light of maximum intensity from each LED reaches its associated sensor 150 when no sheet passes therebetween. As the leading edge of a sheet moves between the LED and cooperating sensor 150, the light intensity is significantly reduced. During a time interval which is initiated a predetermined time after energization of the stepper motor, the associated sensor 150 is examined by comparing its output signal against a predetermined reference level. If the sensor output signal reaches the reference level, this indicates that a sheet has been delivered to the associated acceleration nips. The sensor output signal is further examined at a plurality of predetermined intervals to measure the intensity of light received by the sensor 150 which is a measured of sheet density. These values are summed to develop an average density value for the sheet which is further averaged with the average density value of a predetermined number of sheets previously dispensed from the same input location, which average is updated upon the receipt of each successive sheet. This adaptive density detection technique utilizes an average of the most recently dispensed sheets to examine for the feeding of single sheets or multiple overlapping sheets.

The LED and cooperating sensor 150' serve the three functions of density detection and assuring the delivery of sheets dispensed for associated input location 22 as well as assuring the delivery of sheets dispensed from each of the other input locations 16, 18 and 20.

As was mentioned hereinabove, the leading edge 37*g* of the feed wheel insert 37 must be halted a minimum predetermined distance from the bottom sheet in the associated cassette 50 in order to be assured that the feed rollers, when accelerated from a standstill, will reach the proper dispensing velocity. To be assured that the feed rollers are halted at the proper position, each input location is provided with a home position sensing assembly 155 shown in FIGS. 1*a* and 1*c* and comprised of an angle bracket 156 having an arm 156*a* secured to sidewall 12 and arm 156*b* for mounting member 157 to arm 156*b* with fastener 158. Member 157 is provided with a slot 157*a*. A pin 42*a* mounted on coupler 42 which couples motor shaft 38*a* to shaft 36, passes through slot 157*a* once per revolution. An LED and cooperating sensor 160 are mounted in member 157 on opposite sides of slot 157*a*. The stepper motor output shaft is halted to position the leading edge 37*g* of feed roller insert 37 and hence the positioning pin 42*a* at the proper location in readiness for a subsequent sheet dispensing operation. When the stepper motor 38 is halted, sensor 160 is examined to be assured that pin 42*a* is in the proper position. When pin 42*a* is in alignment with the LED and cooperating sensor 160, this is an indication that the feed roller is in the proper position for a subsequent sheet dispensing operation.

In the event that pin 42*a* fails to block light from the LED from reaching the cooperating sensor 160, the stepper motor 38 is moved under control of a routine which moves the stepper motor output shaft in a predetermined pattern to move the feed roller to the proper position in readiness for a subsequent sheet dispensing operation.

A sheet dispensing operation is performed in the following manner:

Assuming that it is desired to dispense paper currency, the cassette 50 for each input location is filled with paper currency of the proper denomination. In the example given, it is preferred that twenty-dollar ($20.00) bills be placed at input location 16; ten-dollar ($10.00) bills be placed at input location 18; five-dollar ($5.00) bills be placed at input location 20 and one-dollar ($1.00) bills be placed at input location 22. Each cassette may be provided with indicia to identify the denomination it is intended to receive. An associated indicia may be provided at each input location, for example along one or both of the side walls 12 and 14. As an example of one type of indicia which may be used, each input location and cassette may be color-coded. Alternatively, the denomination may be printed at each input location and cassette such as for example the indicia "$20." may be placed at the input location 16 and along one exposed wall of the associated cassette. In addition, each cassette may be provided with a separate notch and each input location may be provided with an associated projection wherein the projection at each input location is located at a different position and the location of the notch is aligned with the projection of only that input location for which the cassette is intended to be inserted. More specifically, a different one of the projecting arms 52*a* of currency support member 52 (see FIG. 7) may be made longer than the remaining projections. The bottom slot 50*f* of only the cassette intended for that location is likewise made longer so as to accomodate the longer projection. Each cassette will uniquely fit into one and only one input location. Other mechanical arrangements may be utilized, if desired.

After each cassette is inserted into its appropriate input location, the amount of paper currency to be dispensed is inputted into the dispenser by means of a keyboard (not shown). Assuming that $56.00 is to be dispensed the dispenser 10, in order to dispense the smallest number of paper bills, will dispense two twenty-dollar bills; one ten-dollar bill; one five-dollar bill; and one one-dollar bill. Each stack of sheets is tilted due to the insertion of the currency support projections 52*b* into the bottom of the cassettes.

The dispensing operation begins with dispensing of the twenty-dollar bills by operating stepper motor 38 for input location 16. The feed rollers 32, 34 for input location 16 are accelerated to the dispensing velocity whereupon the leading edges 37*g* of the inserts 37 engage the bottom twenty-dollar bill in the cassette. The notch 34*g* adjacent to the leading edge 37*g* of the insert enables the leading edge of the bottom sheet to move out of dispensing opening 51 (see FIG. 5*b*) and into the tapered entrance throats formed by the feed rollers 32, 34 and the convex surface portion of the cooperating stripper shoes 46, 46 to be assured that the leading edge of the bottom sheet engages the convex surface 46*a* of the stripper shoes 46 as the leading edge of each insert 37 moves beneath its associated stripper shoe to assure delivery of the bottom sheet past the stripping location, along curved guide 66 and into the acceleration nips of the associated input location. The sensor 150 of the associated input location is examined during a predetermined time interval to be assured that a sheet has in fact been delivered to the acceleration nip. The motor 94 for the acceleration belts 92*a*, 92*b* is constantly rotated and delivers the first twenty-dollar bill along the acceleration belts 92*a*, 92*b* and between each successive pair of acceleration nips and eventually into the output stacker 137. The right-hand most sensor 150' assures the delivery of the twenty-dollar bill from the downstream end of belts 92*a*, 92*b* to stacker 137.

Since two twenty-dollar bills are intended to be dispensed, rotation of the feed rollers for the input location 16 continues through a second full revolution to dispense a second twenty-dollar bill which is again monitored by the same sensor used to monitor the first dispensed twenty-dollar bill. The feed rollers for input location 16 are brought to a halt at the aforementioned predetermined location. The positioning pin 42*a* for input location 16 is examined to be assured that the feed rollers have been brought to rest at the proper location in readiness for a subsequent dispensing operation.

The successive dispensing of a ten-dollar bill, five-dollar bill and one-dollar bill are performed in a substantially similar fashion by the dispensing apparatus at each of the dispensing locations 18, 20 and 22. The dispensing operation is halted after the one-dollar bill has been dispensed. Completion of the dispensing operation is accompanied by a suitable audio-visual alarm.

The modular design of the dispensing apparatus enables the use of a lesser or greater number of individual dispensing locations with the one design change being an increase or decrease in the length of the acceleration assembly. The unique design of the present invention eliminates the need for picker rollers typically employed in conventional bottom feed apparatus making it possible to position adjacent dispensing locations in close proximity to one another thereby reducing the length of the acceleration assembly.

Figure 7:
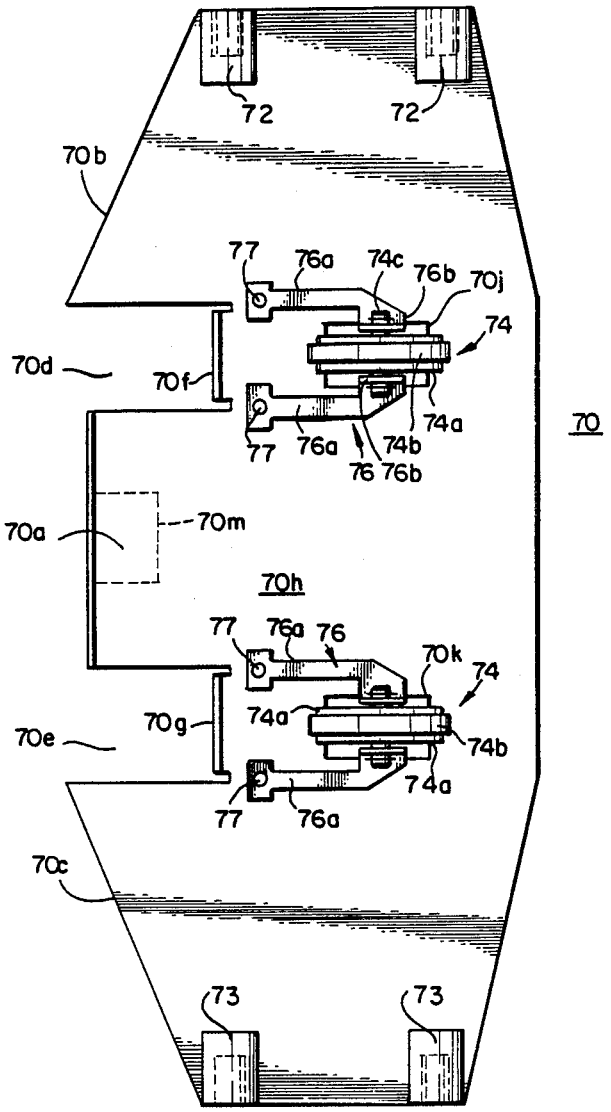
FIG. 7 is a top plan view of a guide plate for mounting a sensor and an acceleration pinch roller provided for each individual dispensing device.

The acceleration drive may be further improved by providing acceleration means in addition to the acceleration pinch wheel rollers 74 and their associated resilient mounting assemblies 76 (see FIG. 7). Such acceleration drive may be provided by a pair of freewheelingly mounted rollers 180*a*, 180*b* mounted along opposite sides of feed rollers 32 and 34 forming part of input location 18 as shown in FIG. 1*a*. Each roller is freewheelingly mounted upon shaft 36 and is provided with the resilient O-rings 182*a*, 182*b*. The acceleration belts 92*a* and 92*b* are spaced further apart than presently shown in FIG. 1*a* so as to be located beneath the freewheeling pinch rollers 180*b*, 180*a* whose O-rings 182*b*, 182*a* cooperate to form acceleration nips with the associated belts 92*b*, 92*a*. The rollers 85, 87 and 89 are also moved outwardly and to the left from the positions shown in FIGS. 1*a* and 1*b* so that they are arranged below each acceleration nip formed by rollers 180*a*, 180*b* to provide good rolling support for the belt at the location of the newly added acceleration nips. Obviously, the design modification further necessitates moving the pairs of rollers 85, 87 and 89 so that they lie beneath their associated acceleration belts 92*a*, 92*b* and idler rollers (not shown) which correspond to the rollers 180*a*, 180*b*. An additional pair of rollers positioned to the left of rollers 91*a*, 91*b* may be provided for supporting belts 92, 92*b* beneath the freewheeling rollers 180*a*, 180*b* utilized in the input location 22. The acceleration operation is otherwise substantially the same as that described hereinabove except that the leading edges of each sheet enter the acceleration nip at an earlier point in time that the first embodiment described hereinabove. Also the pinch wheels 74 are moved so that they engage belts 92a, 92b. Additional rollers may be provided beneath the pinch wheels and for supporting belts 92a, 92b in the same positions occupied by rollers 85, 87, 89, 91.

The spacing between adjacent sets of acceleration nips in the modified design is less than the length of a single sheet measured in the direction movement assuring that the next acceleration nip through which each sheet passes, except for sheets dispensed from input location 92, is positively engaged by the next pair of acceleration nips before leaving the upstream pair of acceleration nips to ensure positive feed of a sheet from each acceleration location to the output stacker, regardless of which input location the sheet originates from.

The LED light sources and their cooperating sensors 150 are also preferably moved toward the left relative to their positions shown in FIG. 1a so as to be positioned substantially in alignment with their associated acceleration nips formed between the freewheelingly mounted rollers 180a, 180b and the acceleration belts 92b, 92a respectively.

In order to prevent the O-rings 182a, 182b on rollers 180a, 180b from inadvertently driving a sheet from a cassette, a pair of curved guides 181a, 181b (see FIG. 1c) are mounted to the apparatus frame by suitable brackets (not shown). The top surfaces of guides 181a, 181b are slightly higher than the outer periphery of O-rings 182a, 182b to keep the bottom sheet in a cassette 50 from engaging the O-rings. The width of slots 50g in cassette 50 are sufficient to allow the O-rings 182a, 182b and curved guides 181a, 181b to extend through floor 50e. Alternatively, the floor 50e of cassette 50 may be provided with a pair of raised surfaces 50n (see FIG. 5c) to lift the bottom sheet and prevent O-rings 182a, 182b from engaging the bottom sheet and accidently driving the sheet toward the acceleration belts.

FIG. 9 is a block diagram of the system controller 200 comprising a central processing unit (CPU) 201 including input/output (I/O) and membory. The operator inputs data to the CPU (i.e. amount to be dispensed) through keyboard 202, display 204 displays the amount inputted, as well as indications of error, completion, etc.

The stepper motor drive 206 selectively drives the stepper motors 38 (see FIGS. 1c, 2 and 2a) to dispense the selected bills. Stepper motor detection circuit 208 couples signals from the home position sensors 160 (FIG. 1c) to assure that the stepper motors 38 are in the proper position prior to initiation of a bill dispensing operation for the associated dispensing device. The CPU moves the feed roller until the pin 42a is properly aligned. The sensor 150 closest to the output stacker 137 (FIG. 1b) is also examined by the CPU to assure delivery of bills from dispensing devices 16, 18 and 20 to the output stacker.

The d.c. motor drive 210 is coupled to motor 94 (FIG. 1a) to control the acceleration belts 92a, 92b.

The count and double detector circuitry 212 couples signals from the sensors 150 to the CPU for counting bills and for detecting the presence of multiple fed and/or overlapping bills.

The empty bin detector circuit 214 couples signals from sensors such as 151 arranged on each plate portion 24b (see FIG. 1b) and aligned with a suitable opening in the cassette 50 for detecting a low or empty bin condition.

The output tray sensor circuit 216 couples sensor 153 (FIG. 1b) to the CPU, which prevents a new dispensing operation until the output tray is cleared.

The CPU may also be utilized to control a coin dispenser (not shown) through control circuit 218.

The drive signal applied to a stepper motor 38 causes the associated feed roller to feed a bill. At a predetermined time the status of the associated sensor 150 is examined. If a bill has passed the sensor during that time interval, the dispensing operation continues. If the sensor 150 indicates no bill has passed the operation of the stepper motor is repeated. The number of repeat operations is adjustable and may be one or more.

The state of sensor 150' closest to the output stacker is also examined at a time interval dependent upon the bill denomination being dispensed to assure that a bill from the dispenser locations 16, 18 and 20 have been passed to the output stacker. In the event that no bill has passed the sensor 150' the operation is halted and an alarm indication is provided by display 204.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for dispensing rectangular sheets of flexible material such as sheets of paper currency one at a time in a direction generally perpendicular to the smaller dimension thereof including in combination, a cassette for receiving a stack of said sheets, said cassette having a generally rectangular floor somewhat larger than the size of the sheets to be dispensed, a front wall and a back wall and side walls extending upwardly from said floor, an elongated dispensing slot defined by the lower edge of said front wall and the edge of said floor adjacent to the front wall lower edge to permit the bottom sheet of a stack to pass out of the cassette in a direction transverse to its smaller dimension, a plurality of guide slots at spaced intervals along the edge of said floor adjacent to said rear wall, said guide slots spanning a distance greater than half the longer dimension of said sheets, a feed slot in the floor of said cassette adjacent to said dispensing slot, feed means extending through said feed slot when said cassette is present in said cavity, and a plurality of projections in said cavity extending respectively through said guide slots when said cassette is placed in said cavity to align said cassette in said cavity and directly to engage the lowermost sheet of a stack of sheets in said cassette along the edge of the lowermost sheet adjacent said back wall and to raise the entire stack of sheets from said floor while inclining the lowermost sheet to cause the edge thereof adjacent the front wall to engage said feed means, operation of said feed means freeing the lowermost sheet of said stack from the weight of the stack before the lowermost sheet moves out through said dispensing slot.

2. The apparatus of claim 1 further comprising reinforcing projections along the bottom surface of the floor of said cassette for reinforcing said floor and having guide surfaces for guiding the guide projections into said guide slots.

3. The apparatus of claim 1 wherein the surface of said floor is flat to support the stack of sheets arranged parallel to said floor when the cassette is removed from the cassette receiving cavity.

4. The apparatus of claim 1 wherein the cassette receiving cavity is larger than the bottom of the cassette;

resilient bias means along one side of the cavity for urging the cassette toward the opposite side of the cavity of properly align the cassette with the feed means.

5. The apparatus of claim 4 wherein said feed slot is adjacent to said dispensing slot;

said feed means comprising a feed roller projecting through said feed slot and a stripper shoe cooperating with said feed means for feeding only one sheet at a time from said cassette toward an outfeed location.

6. The apparatus of claim 1 further comprising a pair of projecting surfaces along the interior of the cassette sidewall forming the dispensing slot to reduce the surface area of engagement between the adjacent edges of the sheets and cassette.

7. The apparatus of claim 6 further comprising an elongated slot provided in the sidewall adjacent to said guide slots to facilitate insertion and removal of sheets from the cassette.

8. The apparatus of claim 1 further including a plurality of dispensing devices and cassettes wherein each cassette is provided with a slot arranged to receive a keying projection of only one of the dispensing devices, the keying projections of each dispensing device being arranged in a diferent position relative to the other devices.

9. The apparatus of claim 8 further comprising a common guide member for aligning the cassette of one dispensing location along one side thereof with its associated feed roller and for supporting the guide member of the cassette positioned in the cavity opposite side of the common guide member.

10. The apparatus of claim 9 wherein said feed means has a frictional drive surface provided with slots to improve the frictional engagement between said surface and a sheet.

11. The apparatus of claim 9 further comprising a stepper motor for driving said feed roller.

12. The apparatus of claim 9 further comprising a drive motor coupled to the feed roller and including means for controlling the number of rotations experienced by said feed roller.

13. The apparatus of claim 1 further comprising idler roller means rotatable about an axis common with the axis of rotation of said feed means;

acceleration means forming a acceleration nip with said idler roller means for rotating said idler roller means and accelerating sheets fed to the acceleration nip by said feed means;

said idler roller means extending into the bottom of the cassette.

14. The apparatus of claim 13 further comprising shield means arranged adjacent to the idler roller means for supporting the stack of sheets and displacing the bottom sheet in the stack from the periphery of the idler roller means to prevent the bottom sheet from being driven by the idler roller means as it approaches the feed nip.

15. The apparatus of claim 14 wherein the shield means is an integral part of said cassette.

16. The apparatus of claim 1 further comprising a sheet guide member having a curved smooth low friction surface which is placed the forward end of the stripper shoe to guide the leading edges of curled sheets toward the feed nip.

17. The apparatus of claim 16 wherein the stripper shoe is provided with a pair of slots for receiving a mounting member which supports the stripper shoe;

said sheet guide member having a pair of integral arms each extending into one of said slots for supporting said sheet guide member with said curved surface covering the forward end of said stripper shoe.

18. Apparatus for dispensing rectangular sheets of flexible material such as sheets of paper currency from a stack of sheets at a dispensing location including in combination a cassette comprising a housing having sidewalls and a floor for receiving a stack of sheets, an elongated dispensing slot defined by the floor and the lower edge of one of said sidewalls to permit the bottom sheet of the stack to pass out of the cassette, a feed slot formed in the floor of said cassette adjacent to said delivery slot, means at said dispensing location for removably positioning said cassette in an operative position, a feed member extending through said feed slot in the operative position of the cassette, and means responsive to positioning of said cassette in said operative position for engaging the bottom sheet of said stack over a major portion of its longer dimension adjacent to the sidewall opposite to said one sidewall and to raise the entire stack from said floor while inclining the bottom sheet to cause the edge thereof adjacent said one wall to engage said feed member, operation of said feed means freeing the bottom sheet of said stack from the weight of said stack before the bottom sheet moves out through said dispensing slot.

19. Apparatus as in claim 18 in which said cassette floor and opposite sidewall are formed with a guide slot, and in which said stack end elevating means comprises a member on said cassette receiving means for entering said guide slot as said cassette is moved into its operative position.

* * * * *

UNITED STATES PATENT AND TRADEMARK OFFICE

CERTIFICATE OF CORRECTION

PATENT NO. : 4,728,096

DATED : March 1, 1988

INVENTOR(S) : Winkler et al

It is certified that error appears in the above-identified patent and that said Letters Patent are hereby corrected as shown below:

Column 19, line 5, "of" should be --to--;

Column 19, line 35, after "cavity", insert --inserted to the--;

Column 20, line 14, delete "the forward end of" and substitute --in front of--.

Signed and Sealed this

Second Day of August, 1988

*Attest:*

DONALD J. QUIGG

*Attesting Officer*

*Commissioner of Patents and Trademarks*